US005243310A

United States Patent [19]

Calco

[11] Patent Number: 5,243,310

[45] Date of Patent: Sep. 7, 1993

[54] THREE POINT LEAD SCREW POSITIONING APPARATUS FOR A CAVITY TUNING PLATE

[75] Inventor: Frank S. Calco, Olmsted Falls, Ohio

[73] Assignee: The United States of America as represented by the Administrator of the National Aeronautics and Space Administration, Washington, D.C.

[21] Appl. No.: 826,547

[22] Filed: Jan. 27, 1992

[51] Int. Cl.[5] ..... H01P 7/06

[52] U.S. Cl. ..... 333/233; 315/5.54

[58] Field of Search ..... 333/232, 233, 224–226; 315/5.48, 5.54, 39.61

[56] References Cited

U.S. PATENT DOCUMENTS

| | | | |
|---|---|---|---|
| 2,263,184 | 11/1941 | Mouromtseff et al. | 315/5.48 |
| 2,405,229 | 8/1946 | Mueller et al. | 331/99 |
| 2,833,926 | 5/1958 | Silvey et al. | 333/225 X |
| 2,856,557 | 10/1958 | Allen | 315/5.48 X |
| 2,905,011 | 9/1959 | Armstrong et al. | 333/232 X |
| 2,930,928 | 3/1960 | Lebacqz | 315/5.43 |
| 3,264,513 | 8/1966 | Bagnall | 315/5.22 |
| 3,441,794 | 4/1969 | Chun | 315/39.61 |
| 4,243,961 | 1/1981 | Faillon et al. | 333/233 |
| 4,792,772 | 12/1988 | Asmussen | 333/233 X |

*Primary Examiner*—Benny T. Lee

*Attorney, Agent, or Firm*—Gene E. Shook; James A. Mackin; Guy M. Miller

[57] ABSTRACT

Three lead screws are provided for adjusting the position of a traversing plate. Each of the three lead screws is threaded through a collar that is press fitted through the center of one of three pinion gears. A sun gear meshes with all three pinion gears and transversely moves the three lead screws upon actuation of a drive gear. The drive gear meshes with the sun gear and is driven by a handle or servo motor. When the handle or servo motor rotates the drive gear, the sun gear rotates causing the three pinion gears to rotate, thus causing transverse movement of the three lead screws and, accordingly, transverse movement of the transversing plate. When the drive gear rotates, the traversing plate is driven in and out of a microwave cavity. Thus, the length or size of the cavity can be tuned while maintaining the traversing plate in an exact parallel relationship with an opposing plate on another end of the cavity.

7 Claims, 3 Drawing Sheets

THREE POINT LEAD SCREW POSITIONING APPARATUS FOR A CAVITY TUNING PLATE

ORIGIN OF THE INVENTION

The invention described herein was made by an employee of the U.S. Government and may be manufactured and used by or for the Government for governmental purposes without the payment of any royalties thereon or therefore.

BACKGROUND OF THE INVENTION

Field of the Invention

The present invention relates generally to a position adjusting apparatus and, more particularly, to an apparatus for adjusting the position of an end plate of a microwave cavity. This invention has been known as combined action lateral control operation tuning or CALCO tuning.

Description of the Related Art

In general, previous designs provided a plate or wall section of a cavity movably guided on three or four stationary rods. The rods had compression springs to maintain a force against the plate or wall. The plate or wall section was movably guided in slots. Gear arrangements have been applied where different threads and pitch diameters are used in opposition to each other in an effort to minimize backlash. In some designs, the inner diameter of the cylinder body which forms the cavity had a thread arrangement on the outer diameter and had extended rods over the end with a 90# connection to control arms. When in motion, the arms would position the inner plate that forms the cavity sides. However, in this arrangement, it was difficult to maintain the plate parallel to an opposing wall or provide an accurate cavity size or distance.

U.S. Pat. No. 2,263,184 issued to Mouromtseff et al., issued Nov. 18, 1941, U.S. Pat. No 2,930,928 issued to Lebacqz on Mar. 29, 1960 and U.S. Pat. No. 3,264,513 issued to Bagnall on Aug. 2, 1966 disclosed triangular or three point support system for tuning high frequency or microwave cavities. Each of these patents addressed the problem of precise adjustment of the cavity for tuning. However, none of these patents effectively solved the problem of keeping the plate or wall parallel with opposing walls to provide optimum resonance in a cavity. Furthermore, none of these patents provided for very exact cavity distance or size adjustments.

SUMMARY OF THE INVENTION

It is an object of the present invention to provide an apparatus for adjusting the length of a cavity while maintaining front and rear walls precisely parallel to one another.

Another object of the present invention is to provide an apparatus for precisely adjusting the position of a front wall with respect to a rear wall with accuracies of about 0.1 mm.

Still another object of the present invention is to provide for the translation of two plates or walls relative to one another while being maintained in an exact parallel condition.

Yet another object of the present invention is to provide a simple apparatus for easily adjusting position while maintaining a parallel condition.

Additionally, an object of the present invention is to provide a stationary drive arrangement that has a synchronized multi-lead screw positioning system to precisely set an interior length of the working chamber.

In order to achieve the foregoing and other objects, in accordance with the purposes of the present invention as described herein, three lead screws are provided for adjusting the position of a traversing plate. Each of the three lead screws are threaded through the center of one of three pinion gears. A sun gear meshes with all three pinion gears and transversely moves the three lead screws upon actuation of a drive gear. The drive gear meshes with the sun gear and is driven by a handle or servo motor. When the handle or servo motor rotates the drive gear, the sun gear rotates causing the three pinion gears to rotate, thus causing transverse movement of the three lead screws and, accordingly, transverse movement of the transversing plate. A self-contained bracket holds the drive gear and a three point control bracket holds the sun gear and the three pinion gears, with respective bearings. The self-contained bracket and the three point control bracket are mounted on the base end plate. The base end plate is mounted on an end of a cavity such as a microwave resonance cavity. When the drive gear rotates, the traversing plate is driven in and out of the cavity. Thus, the length or size of the cavity can be tuned while maintaining the traversing plate in an exact parallel relationship with an opposing plate on another end of the cavity.

These and other features and advantages of the present invention will become more apparent with reference to the following detailed description and drawings. However, the drawings and description are merely illustrative in nature and not restrictive.

BRIEF DESCRIPTION OF THE DRAWINGS

The accompanying drawings illustrate several aspects of the present invention, and together with the descriptions serve to explain the principles of the inventions. In the drawings.

DETAILED DESCRIPTION OF THE PREFERRED EMBODIMENTS

Figure 1:
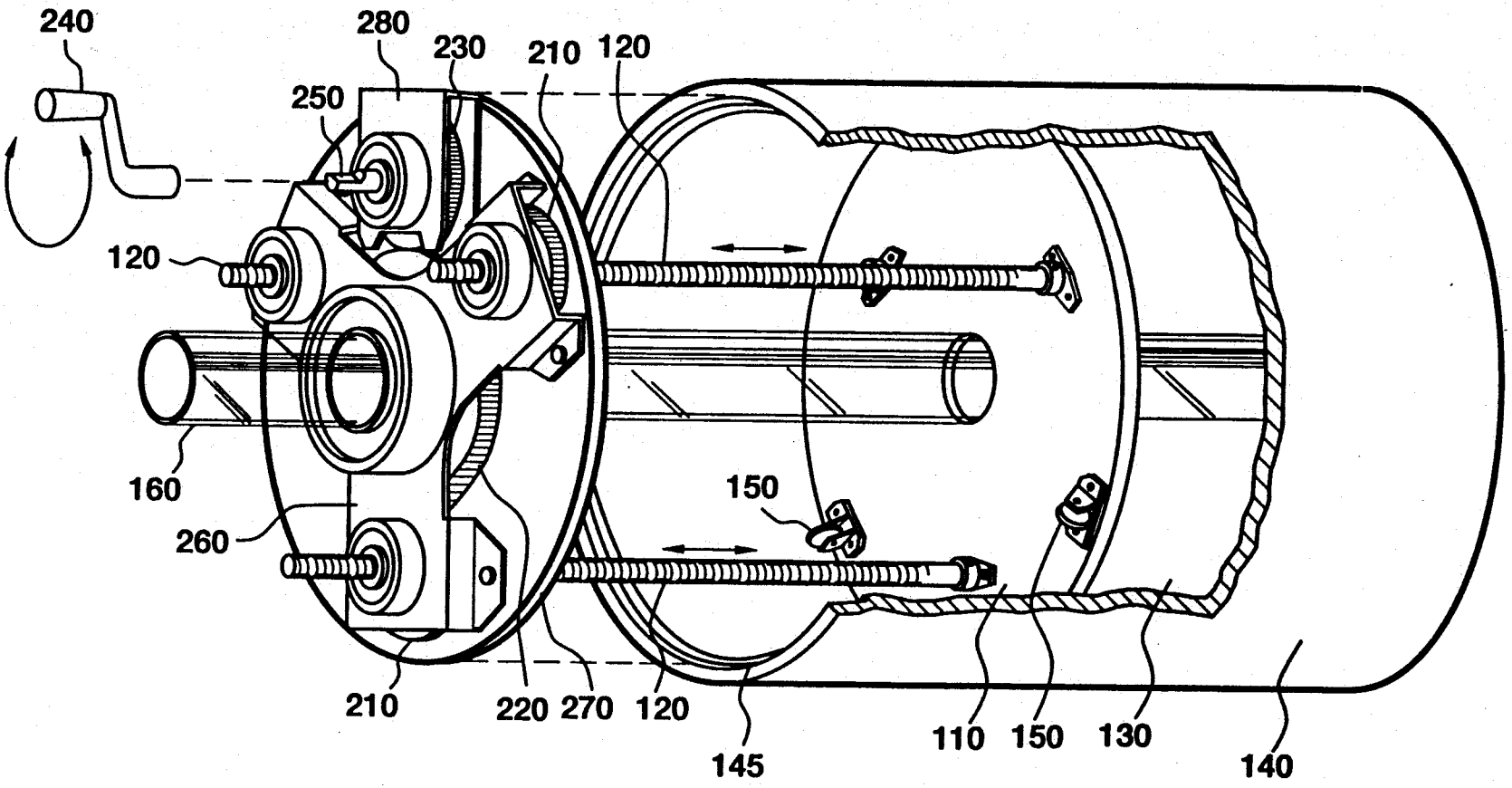
FIG. 1 is a proportional view of the three point lead screw positioning apparatus of the present invention including the microwave cavity attached thereto.

FIG. 1 illustrates a proportional view of the three point lead screw positioning apparatus of the present invention. Traversing plate 110 traverses laterally upon the movement of the three lead screws 120 as shown by the arrows adjacent to these screws. Movement of the traversing plate 110 adjusts the size of the working chamber 130 shown in FIGS. 2 and 3 within the cylinder 140 shown in FIGS. 1, 2, and 3. Three casters 150 (only two are shown in FIG. 1) are provided on the travelling plate 110 to ride against an inside diameter of the cylinder 140. The cavity includes a quartz vacuum liner 160 which extends the length of the working chamber 130. The quartz vacuum liner 160 is tubular in shape and made of quartz glass.

Each of the three lead screws 120 are threaded onto one of three pinion gears 210 (only two are shown in FIG. 1). When the three pinion gears rotate, they cause transverse movement in a lateral direction of the three lead screws 120 as shown by the arrows adjacent thereto. The three lead screws 120 can be threaded on their outside surface only over the portion necessary for engagement with one of the three pinion gears 210. A sun gear 220 meshes with each of these three pinion gears 210 and meshes with a drive gear 230. When the drive gear 230 rotates, the sun gear 220 causes each of the three pinion gears 210 to rotate. A handle 240 can be connected to a drive pin 250 as illustrated in FIG. 1. The handle 240 provides movement of the drive gear 230 and thus, via the sun gear 220 and the three pinion gears 210, transversely moves the three lead screws 120 in a lateral direction. Therefore, the handle 240 provides movement of the traversing plate 110. However, a servo motor or other source of rotating force can be employed as will be illustrated and discussed in FIG. 3.

A three point control bracket 260 holds the three pinion gears 210 onto a base end plate 270. A self-contained bracket 280 holds the drive gear 230 onto the base end plate 270. The base end plate 270 is affixed to the cylinder 140 at the cylinder end 145. However, other arrangements are possible. For example, the three lead screws 120 can be stationary and the base end plate 270 can move on the lead screws 120 in response to rotation of the drive gear 230. A fixed plate or microwave energy magnet at an opposing end could be held stationary and the cylinder caused to slide thereover to adjust the size or length of the cavity or working chamber 130.

The cylinder 140 can be made of brass or aluminum with surfaces finished to retain a high conductivity and a low point-to-point contact resistance. The cylinder 140 has an inside diameter of about 18 inches, however the diameter can range from about 17 inches to about 19 inches. The lateral position of the traversing plate 110 can be moved over a range of about 3 inches. The working chamber 130 has a length over the range of about 6.5 inches to about 9.5 inches or can have a range of about 13.0 inches to 16.0 inches for the 18 inch inside diameter cavity.

The interior surface of the cylinder 140 and the surface of the travelling plate 110 facing the working chamber 130 are polished or coated so as to be highly reflective to visible and infrared radiation. No sharp exposed edges or projections can be tolerated and the internal corners should be generously radiused or rounded. No deviation from a true cylindrical geometry should exist except for finger stock on a flange of base end plate 270.

Figure 2:
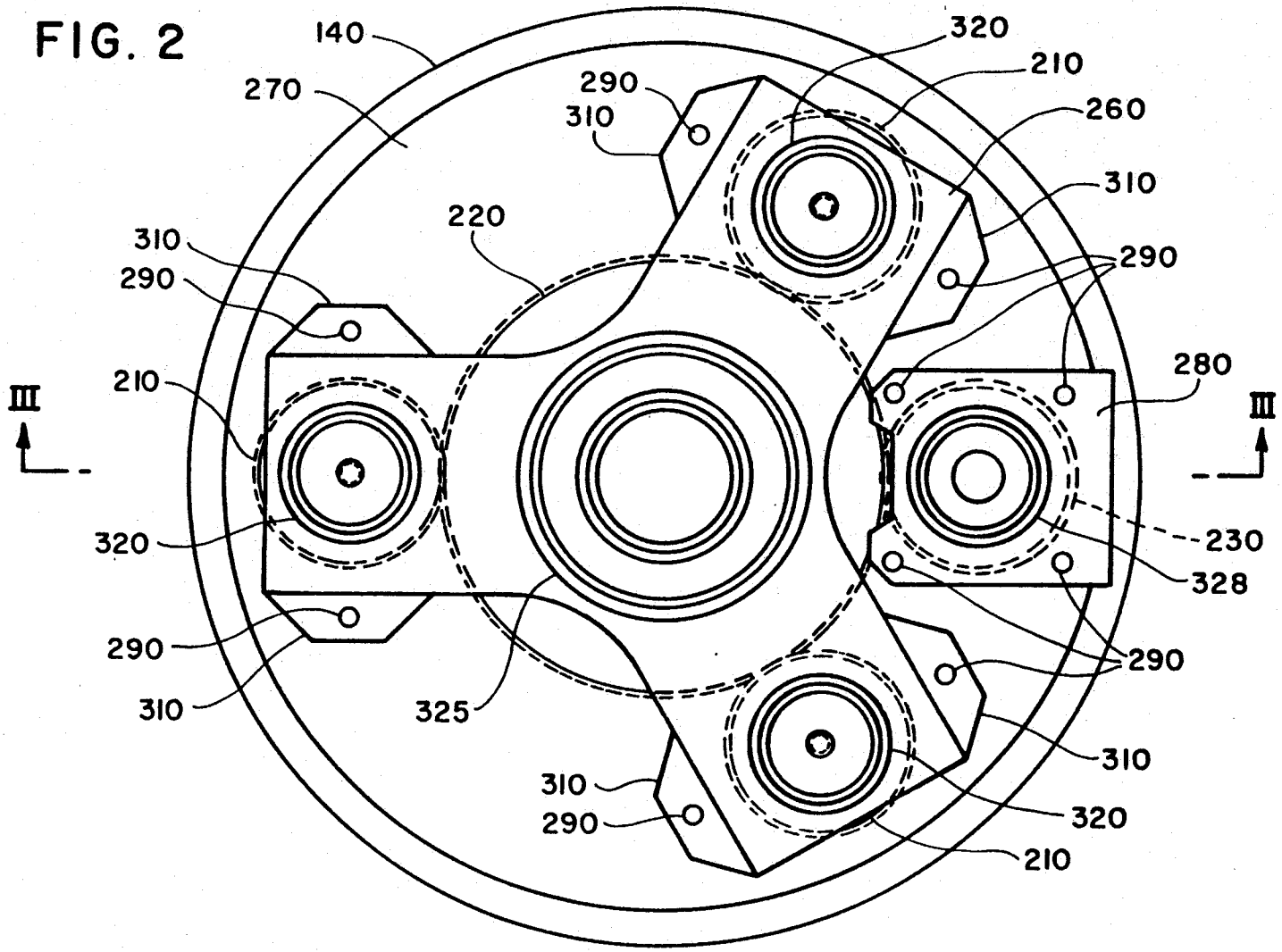
FIG. 2 is a top view of the three point lead screw positioning apparatus of the present invention.

FIG. 2 illustrates a view of the three point lead screw positioning apparatus of the present invention circumscribed by the cylinder. The three point control bracket 260 and self-contained bracket 280 hold the components on the base end plate 270. The three point control bracket 260 and self contained bracket 280 are mounted by fasteners to the base end plate at through-holes 290 in the bracket 280 and extended two pad mounts 310 shown in FIGS. 2 and 3. The drive gear 230 is held by self-contained bracket 280 and the three pinion gears 210 and the sun gear 220 are held by the three point control bracket 260. The extended two-pad mount 310 is provided on the end plate side of each arm of the three point control bracket 260.

Figure 3:
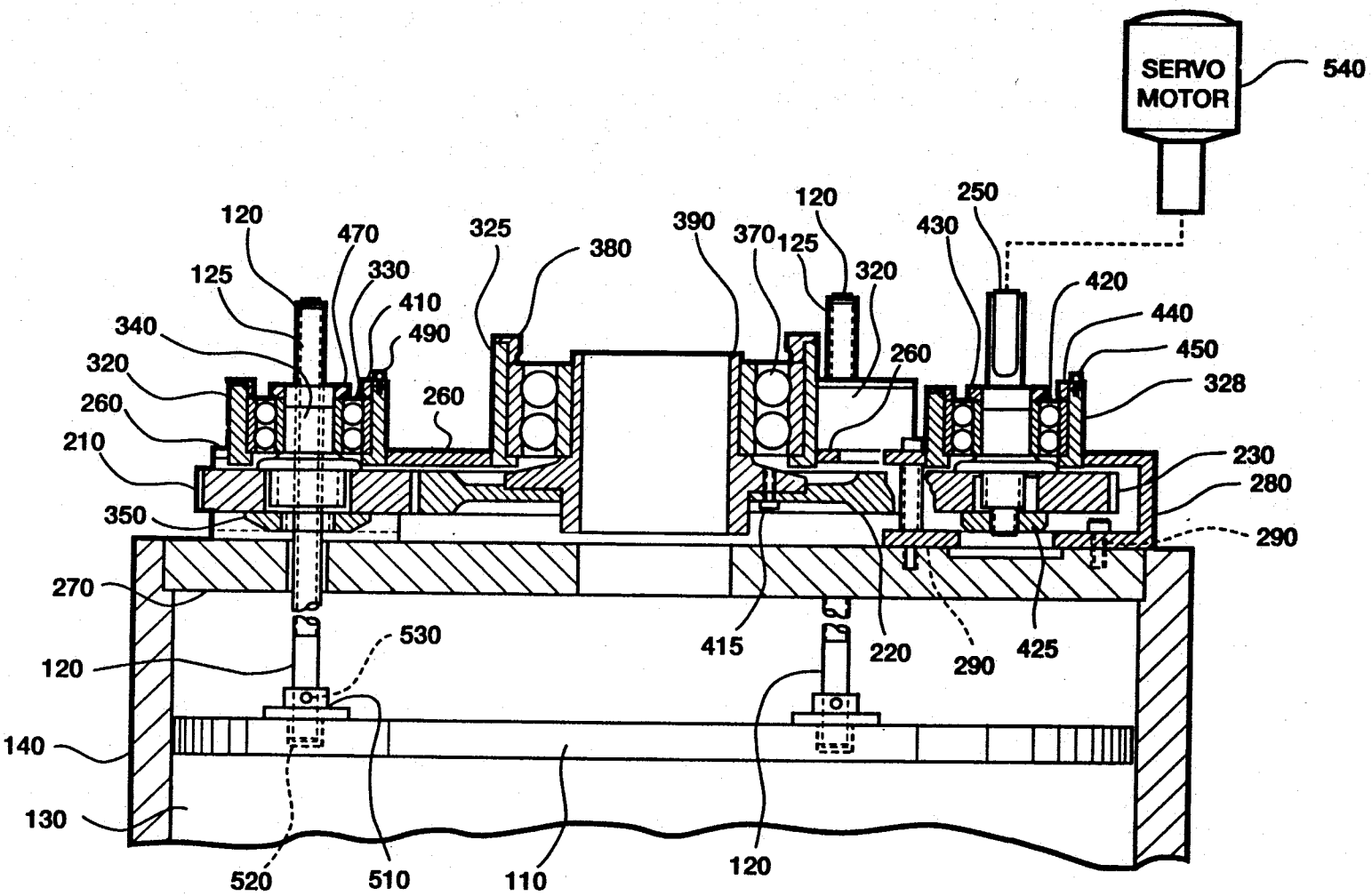
FIG. 3 is a cross-sectional side view of the three point lead screw positioning apparatus illustrated in FIG. 2.

FIG. 3 illustrates a cross-sectional view of the cylinder 140 and the working chamber shown in FIG. 2. As illustrated in FIG. 3, the three point control bracket 260 has a through-hole in each of three arms to pass one of the three lead screws 120 therethrough. An extended sleeve 320 shown in FIGS. 2 and 3 is provided as part of the three point control bracket 260 for mounting there bearings 330, each having an inner race and an outer race on the drive side. The bearings 330 are of the anti-friction type wherein a rolling element, such as a ball or roller, rotates between the spaced races. Reference is made to page 531 of Machinery's Handbook, 13th edition, published by the Industrial Press. Each of the three pinion gears 210 has a keyway. A gear pin/lead screw control collar 340, one of the three pinion gears 210 and a retainer 350 form a subassembly. This subassembly is then inserted into bearing 330 from the pad mount side. A retainer 350 is then threaded onto gear pin/lead screw control collar 340 to secure the subassembly to the bearing 330 at the inner race side. A retainer 350 secures one of the three pinion gears 210. A retainer 470 secures an inner race of the bearing 330. A retainer 410 secures an outer race of the bearing 330 and is secured to the extended sleeve 320 of the three point control bracket 260 by a fastener 490 at a through-hole. The above-described subassembly is created for each of the three arms of the three point control bracket 260 at each of the three pinion gears 210.

A bearing 370 is mounted in a bracket sleeve 325 as part of the center of the three point control bracket 260 and a retainer 380 is placed thereon. Sun gear 220 is mounted on pinion and bearing sleeve 390 and secured in place by a fastener 415 at a through-hole. The pinion and bearing sleeve 390 is also press fit from the mounting side of the bracket to position the pinion and bearing sleeve 390 onto the bearing 370.

The drive pin 250 is pressed into bearing 420 of the drive gear 230. With the drive gear 230 positioned in the channel of the center of the self-contained bracket 280, drive pin 250 and bearing 420 are pressed into the drive gear 230. The drive gear 230 has a keyway which is aligned before the press fit. A retainer 425 is then threaded onto drive pin 350 through a mount side of the self-contained bracket 280 to secure the drive gear 230. A retainer 430 secures an inner race of the bearing 420 and a retainer 440 secures an outer race of the bearing 420 by connection to a drive sleeve 328 shown in FIGS. 2 and 3 of the self-contained bracket 280 by a fastener 450 at a through-hole.

Each of the three lead screws 120 have threads 125 over at least a portion of their length. These threads mesh with threads on the pinion gear 210. The three lead screws 120 are threaded onto each of the three pinion gears 210 in a precise location or thread engagement so that the base end plate 270 remains in a perfect parallel relationship with an opposing end of the cavity, irregardless of its longitudinal position. One of three collars 510 connects one of the three lead screws 120 to the traversing plate 110. The collars 510 fit in holes 520 in the traversing plate 110 and connect to the lead screws 120 by a pin 530.

A servo motor 540 can be used to drive the drive gear 230 as an alternative to the handle 240 illustrated in FIG. 1. The servo motor 540 or the handle 240 would connect to the drive pin 250. A scale and pointer can be attached to the lead screw 120 or other appropriate assembly to indicate a position of the travelling plate 110. Alternatively, an electronic readout such as an LCD or LED can be provided to indicate the tuning position of the travelling plate 110. Thus, a position tuning can be controlled to about 0.1 mm accuracy.

Although the present invention is disclosed for use in tuning a microwave cavity, the invention is clearly applicable to tuning other types of cavities. Additionally, the invention can be used for adjusting machine parts and bed plates. The invention can also be used for raising and lowering platforms, can be used for precise package squaring control and can be used for maintaining a level platform for laser equipment, telescopes including those for optical pyrometry and other optical applications. Also, the invention can be used for cantilevered tail stock applications.

Numerous modifications and adaptations of the present invention will be apparent to those skilled in the art and thus, it is intended by the foregoing claims, to cover all modifications and adaptations which fall within the true spirit and scope of the invention.

What is claimed is:

1. An apparatus comprising:

first, second and third lead screws, each screw having threads on respective outer surfaces thereof:

a movable plate attached to an end of each of said first, second and third lead screws;

first, second, and third collars for receiving respective first, second and third lead screws remote from said plate;

first, second, and third pinion gears having a respective one of said first, second, and third lead screws threaded therethrough adjacent to respective collars;

a three point control bracket for holding each of said first, second, and third pinion gears and said respective collars;

first, second, and third sun gears, each sun gear meshing with a respective first, second, and third pinion gear;

a drive gear meshing with said sun gears;

a one-point drive bracket for holding said drive gear; and drive means operably connected to said drive gear for turning the drive gear and sun gears thereby moving said first, second, and third pinion gears upon operation of said drive means to move said movable plate.

2. An apparatus according to claim 1, further comprising a cylinder having a cavity therein, said plate slidably disposed within said cylinder.

3. An apparatus according to claim 2, further comprising a plurality of casters connected to said plate and ridingly disposed against an inside wall of said cylinder.

4. An apparatus according to claim 2, wherein said three point control bracket and said sum gears each have a through-hole in a center portion thereof; and wherein said apparatus further comprises a respective quartz tube passing through each said through-hole and passing through said cylinder.

5. An apparatus according to claim 1, further comprising a servo motor operatively connected to said drive means.

6. An apparatus according to claim 1, further comprising a handle operatively connected to said drive means.

7. A position adjusting apparatus for a microwave cavity comprising:

a cylinder having a microwave cavity therein with a predetermined length;

a traversing plate disposed within said cavity, said plate comprising one of two ends of the microwave cavity;

first, second, and third lead screws attached to said traversing plate;

first, second, and third collars for receiving respective first, second, and third lead screws remote from said plate;

first, second, and third pinion gears disposed outside said cavity adjacent to respective collars having a respective one of said first, second, and third lead screws threaded therethrough;

respective sun gears meshing with each of said first, second, and third pinion gears;

a drive gear meshing with said sun gears; and drive means operably connected to said drive gear to move said first, second, and third lead screws in and out of said first, second, and third pinion gears upon operation of said drive means thereby adjusting the predetermined length of the microwave cavity by moving said traversing plate.

* * * * *